US007748572B2

(12) United States Patent
Althoff et al.

(10) Patent No.: US 7,748,572 B2
(45) **Date of Patent: *Jul. 6, 2010**

(54) FLUID DISPENSER AND LOCKING MECHANISM

(75) Inventors: Charles Peter Althoff, Cleveland Heights, OH (US); Jason Tilk, Cleveland Heights, OH (US); John William Nottingham, Bratenahl, OH (US); John Richard Nottingham, Bratenahl, OH (US); John Wilford Spirk, Jr., Gates Mills, OH (US); Jay Tapper, Palm Beach Gardens, FL (US); Ian Stuart Midgley, Leeds (GB); David Michael Limb, Wakerfield (GB)

(73) Assignee: Conopco Inc., Englewood Cliffs, NJ (US)

( * ) Notice: Subject to any disclaimer, the term of this patent is extended or adjusted under 35 U.S.C. 154(b) by 147 days.

This patent is subject to a terminal disclaimer.

(21) Appl. No.: 12/009,883

(22) Filed: Jan. 23, 2008

(65) Prior Publication Data

US 2008/0173676 A1 Jul. 24, 2008

Related U.S. Application Data

(60) Provisional application No. 60/886,175, filed on Jan. 23, 2007.

(51) Int. Cl.
*B65D 83/22* (2006.01)

(52) U.S. Cl. ..... 222/153.11; 222/153.13; 222/402.11

(58) Field of Classification Search ..... 222/153.11, 222/153.13, 402.11, 384, 321.7, 321.9
See application file for complete search history.

(56) References Cited

U.S. PATENT DOCUMENTS

| | | | | | |
|---|---|---|---|---|---|
| 3,426,948 | A | | 2/1969 | Stirling | 222/402.11 |
| 3,484,023 | A | | 12/1969 | Meshberg | 222/402.11 |
| 3,782,605 | A | * | 1/1974 | Messenger | 222/153.11 |
| 4,220,263 | A | | 9/1980 | Caruso | 222/183 |
| 4,277,004 | A | | 7/1981 | Barlics | 222/402.14 |
| 4,454,966 | A | | 6/1984 | Hicks | 222/153 |
| 4,477,005 | A | | 10/1984 | Martinez | 224/218 |
| 5,070,611 | A | | 12/1991 | Derin et al. | 30/41 |
| 5,088,121 | A | * | 2/1992 | Wallace | 222/175 |
| 5,411,185 | A | | 5/1995 | Drobish | 222/402.17 |
| 5,649,645 | A | | 7/1997 | Demarest et al. | 222/153.07 |
| 5,839,624 | A | * | 11/1998 | Parsons | 222/402.19 |

(Continued)

FOREIGN PATENT DOCUMENTS

DE 20 2006 010 781 11/2006

(Continued)

OTHER PUBLICATIONS

Pictures of Aerosol Deodorant Body Sprays (0.75 oz., Tag spray (dispenser and insert), (0.75 oz.) Old Spice Red Zone spray, and 1 oz. Axe Spray).

(Continued)

*Primary Examiner*—Kevin P Shaver
*Assistant Examiner*—Jonathan Wood
(74) *Attorney, Agent, or Firm*—Fay Sharpe LLP

(57) ABSTRACT

An aerosol fluid dispenser includes a movable actuator for controlling dispensing of the liquid or fluid product from the dispenser and a locking mechanism for locking the actuator.

19 Claims, 5 Drawing Sheets

U.S. PATENT DOCUMENTS

| | | | | |
|---|---|---|---|---|
| 6,523,722 | B1 | 2/2003 | Clark et al. | 222/153.14 |
| 6,877,643 | B2 * | 4/2005 | Schneider | 222/402.11 |
| D559,702 | S * | 1/2008 | Althoff et al. | D9/692 |
| D574,706 | S * | 8/2008 | Althoff et al. | D9/448 |
| 2004/0143977 | A1 | 7/2004 | Selek | 30/526 |
| 2005/0017027 | A1 | 1/2005 | Yerby et al. | 222/402.13 |
| 2006/0113327 | A1 | 6/2006 | Walters et al. | 222/153.11 |
| 2007/0241134 | A1 | 10/2007 | Gurrisi et al. | 222/153.11 |
| 2008/0173675 | A1 * | 7/2008 | Althoff et al. | 222/153.13 |

FOREIGN PATENT DOCUMENTS

| | | |
|---|---|---|
| FR | 2 569 581 | 3/1986 |
| GB | 2 087 840 | 6/1982 |
| JP | 50-121817 | 9/1975 |
| JP | 2001-163379 | 6/2001 |
| JP | 2004-123136 | 4/2004 |
| WO | 2007-017039 | 2/2007 |

OTHER PUBLICATIONS

Co-pending Application: Applicant: Althoff et al., U.S. Appl. No. 11/625,992, filed Jan. 23, 2007.

Co-pending Application: Applicant: Althoff et al., U.S. Appl. No. 29/276,342, filed Jan. 23, 2007.

Co-pending Application: Applicant: Althoff et al., U.S. Appl. No. 29/276,343, filed Jan. 23, 2007.

PCT International Search Report in PCT application PCT/EP2008/050568.

Derwent Abstract of FR 2 569 581—published Mar. 7, 1986.

PCT International Search Report in PCT application PCT/EP2008/050569.

* cited by examiner

FLUID DISPENSER AND LOCKING MECHANISM

This application claims the benefit of U.S. provisional application No. 60/886,175 filed Jan. 23, 2007.

Aerosol dispensers are particularly useful to dispense liquid cosmetic products, e.g. antiperspirant, deodorant and fragrance products such as cologne and perfume. Often, these aerosol dispensers include a cap or some other means that covers the dispensing outlet to inhibit. Often, these aerosol containers that include caps do not include a locking mechanism to inhibit accidental actuation of the dispenser.

Aerosol dispensers including locking mechanisms are also known. Such dispensers can be used without a cap, as the locking mechanism prevents accidental dispensing. Unfortunately, these locking mechanisms are often complicated to assemble and/or to use, particularly on small scale dispensers.

This application incorporates by reference, in its entirety, application Ser. No. 11/625,992, filed Jan. 23, 2007 and titled "Pocket Sized Fluid Dispenser".

The present invention concerns an aerosol dispenser with a locking mechanism that is both easy to assemble and easy to use.

The locking mechanism of the present invention involves the use of a rotatable locking ring. A problem with such rings is that their rotation can also cause rotation of the element of the dispenser with which they are in contact. When this occurs, rotation of the locking ring relative to the dispenser is at least reduced and the locking ring is less than fully effective. This particular problem is fully addressed by the present invention.

In a first aspect of the present invention, there is provided an aerosol fluid dispenser comprising a rigid container defining a chamber for storing a fluid that is to be dispensed; a valve assembly including a valve cup and a movable valve stem, the valve cup connected to the container and defining an opening in fluid communication with the chamber, and the movable valve stem disposed in the opening for selectively closing the opening and retaining the fluid in the container at a pressure that is greater than atmospheric pressure; a shoulder connected to the container and including a central opening and a slot extending from the central opening; a spray through actuator received in the central opening of the shoulder and including an outlet for dispensing the fluid, an upper platform, a stem socket depending downwardly from the upper platform and an outer wall extending downwardly from the upper platform and at least substantially surrounding the stem socket, the stem socket defining a passage that receives the valve stem and is in communication with the outlet, the stem socket including a spline that is received in the slot to inhibit rotational movement of the actuator with respect to the shoulder; and a locking ring rotatably connected to the shoulder and cooperating with the actuator to limit axial movement of the actuator.

In a second aspect of the present invention, there is provided a method of applying a cosmetic composition comprising the use of an aerosol fluid dispenser according to the present invention.

In accordance with the above aspects of the invention, the locking ring preferably has a "low torque", the torque required to rotate the locking ring being less than that required to rotate the shoulder; both rotations being relative to the rigid container. Preferred torques for rotation of the locking ring and shoulder are indicated in the specific embodiment.

The present invention is particularly suitable as a small scale dispenser, i.e. having a container of volume of less than 60 ml, in particular less than 40 ml, and especially less than 20 ml. Such dispensers may have a diameter of from 1.5 cm to 2 cm and a height of less than 9 cm. The present invention has particular ergonomic benefits when the dispenser is of small scale.

The "volume" of the container should be understood to be its maximum internal volume and equating with the maximum volume of fluid that could be stored within chamber.

An example of another embodiment of an aerosol fluid dispenser includes a rigid container, a valve cup, a movable stem, a shoulder, an actuator, and a locking ring. The rigid container defines a chamber for storing a fluid that is to be dispensed. The valve cup crimps to the container forming an external indentation directed towards the central axis of the container. The valve cup defines an opening in fluid communication with the chamber. The movable stem is disposed in the opening of the valve cup. The shoulder at least partially surrounds and external surface of the valve cup and includes a protuberance disposed in the indentation connecting the shoulder to the valve cup. The actuator contacts the valve stem and the shoulder. The actuator includes a portion having a non-circular configuration cooperating with a portion of the shoulder having a corresponding non-circular configuration to inhibit rotational movement of the actuator with respect to the shoulder while allowing axial movement of the actuator with respect to the shoulder. The locking ring connects to the shoulder for rotational movement with respect to the shoulder and for limiting axial movement of the actuator dependent upon a position of the locking ring.

The individual features of the invention disclosed in the specific embodiment described below should be understood to be useable with other embodiments of the invention falling within the aforementioned first and second aspects of the invention.

DETAILED DESCRIPTION

Figure 1:
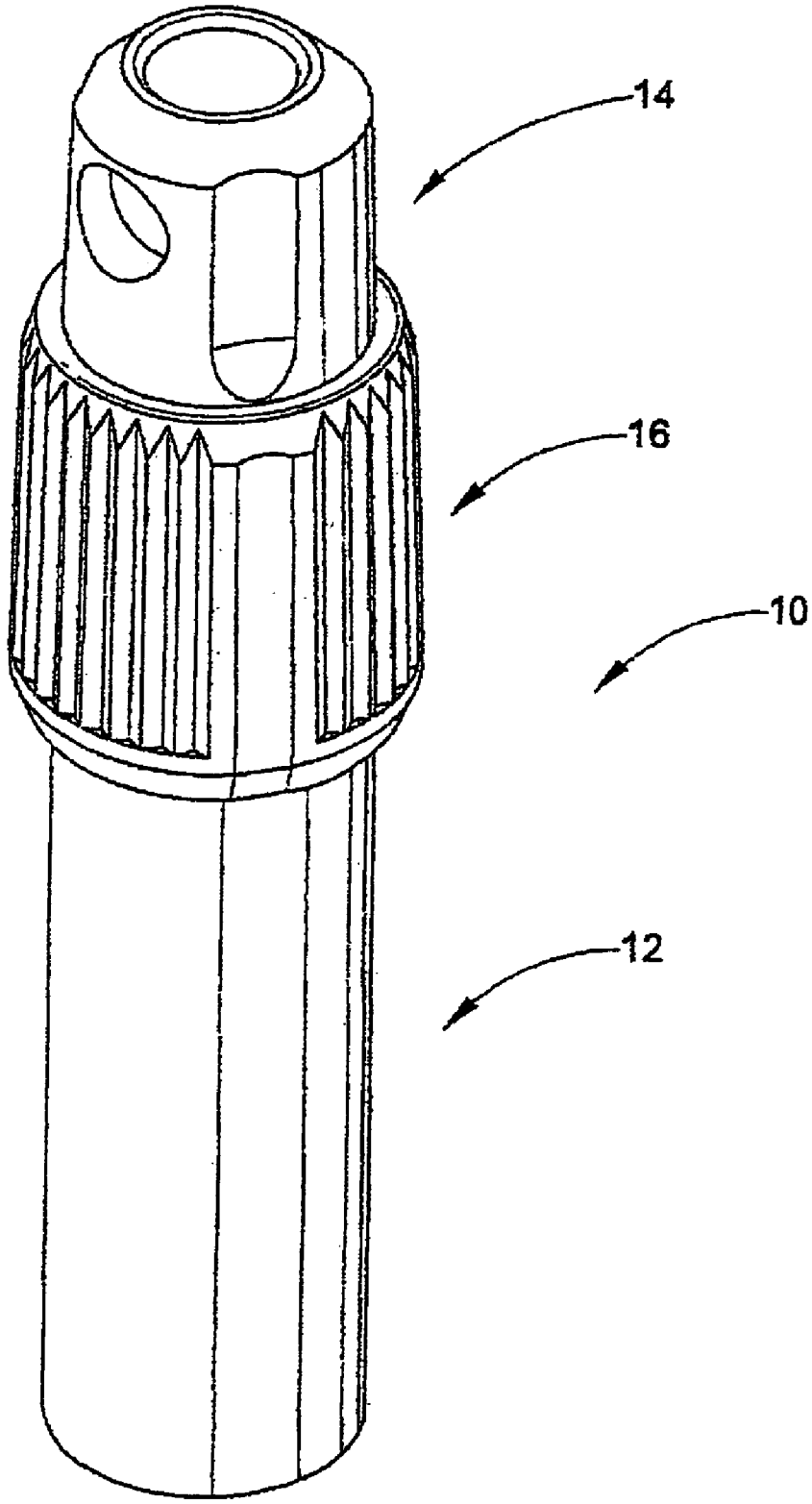
FIG. 1 is a perspective view of a liquid cosmetic product dispenser.

With reference to the embodiment depicted in FIG. 1, a dispenser 10 contains a liquid cosmetic product, which can include hair spray, body spray, deodorant, antiperspirant and fragrances such as perfume and cologne. The dispenser 10 contains the liquid cosmetic product under pressure, i.e. a pressure that is greater than atmospheric pressure, similar to a known aerosol container so that the liquid cosmetic product can be quickly dispensed from the dispenser. The dispenser 10 includes a container 12, an actuator 14, and a locking ring 16. The container 12, the actuator 14 and the locking ring 16 are attached to one another and form a single unit that is disposed or recycled once the liquid cosmetic product has been dispensed from the dispenser.

The container 12 includes a chamber that holds the liquid cosmetic product that is to be dispensed. In the depicted embodiment, the container 12 is cylindrical in shape and similar to a conventional aerosol can. The container 12 can take other configurations without departing from the scope of the invention. The container is cylindrical with an open top and in the depicted embodiment is made from aluminum. Other materials can be used. Where the liquid cosmetic product is to be held under pressure, the other materials should be able to withstand the pressure at which the liquid cosmetic product will be held.

Figure 2:
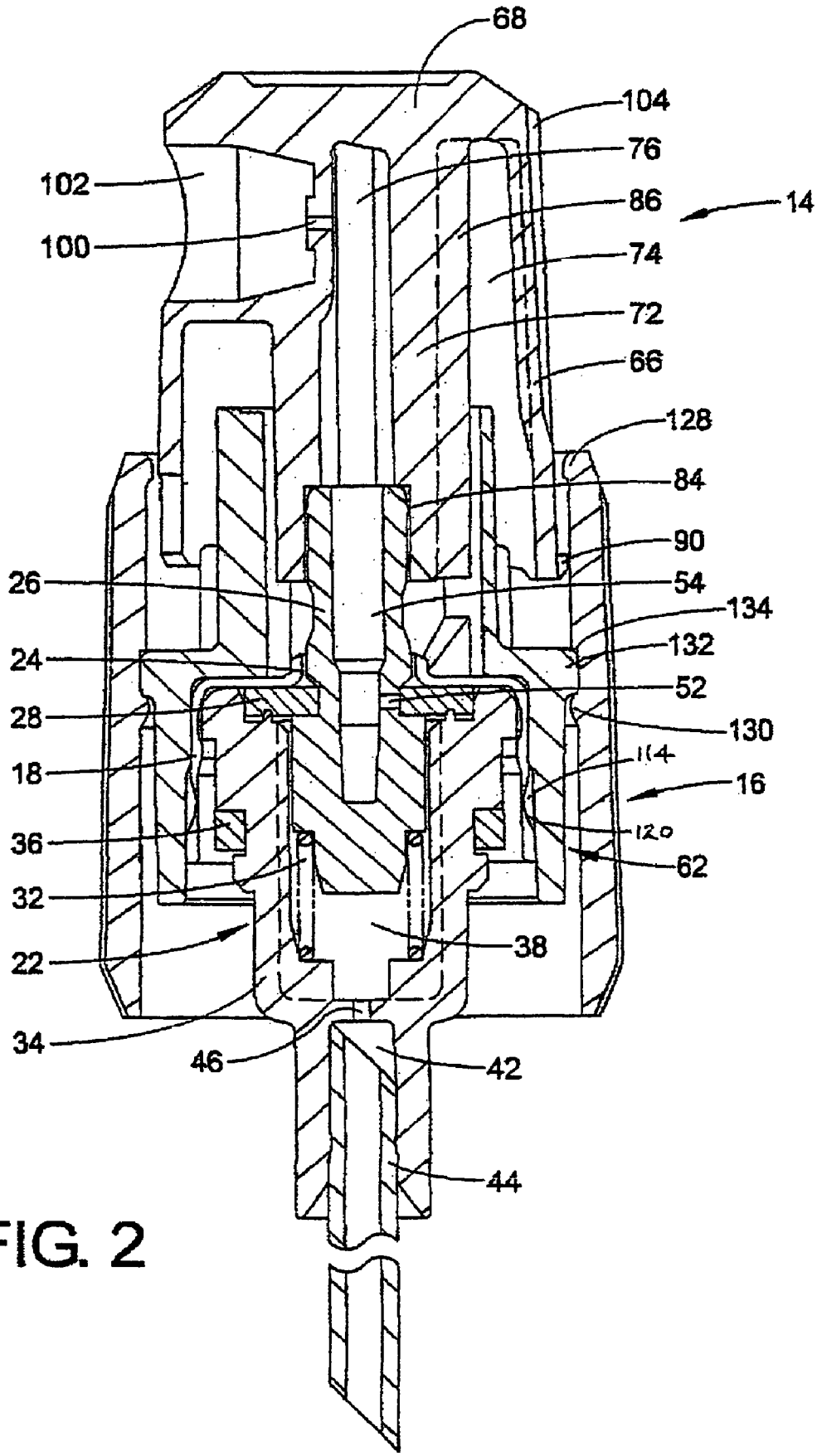
FIG. 2 is a cross-sectional view of an upper portion of the dispenser depicted in FIG. 1.
Figure 3:
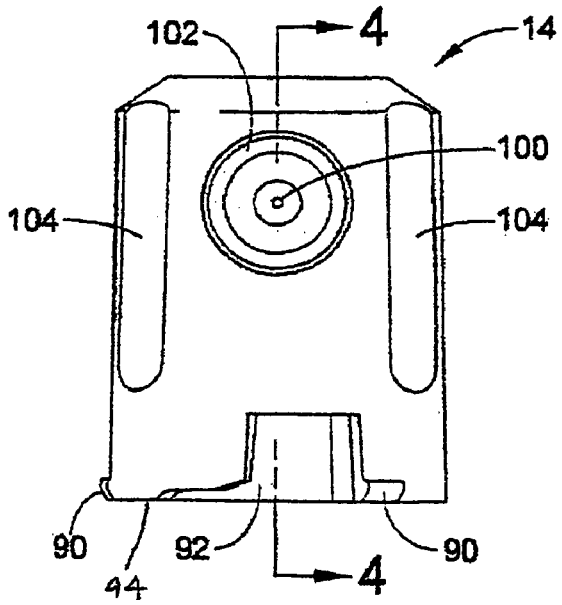
FIG. 3 is a front elevation view of the actuator button for the dispenser of FIG. 1.
Figure 5:
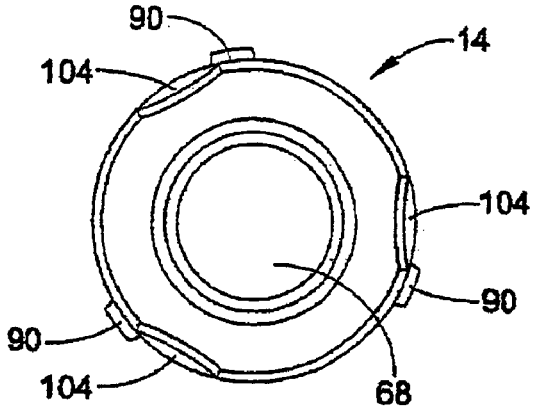
FIG. 5 is a top plan view of the actuator button depicted in FIG. 3.
Figure 6:
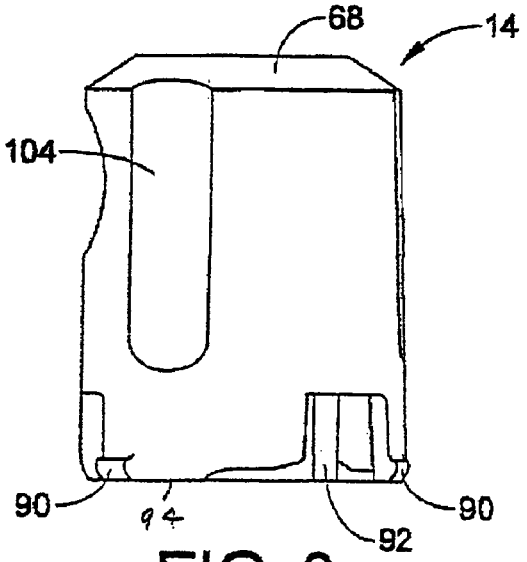
FIG. 6 is a side elevation view of the actuator button depicted in FIG. 3.
Figure 4:
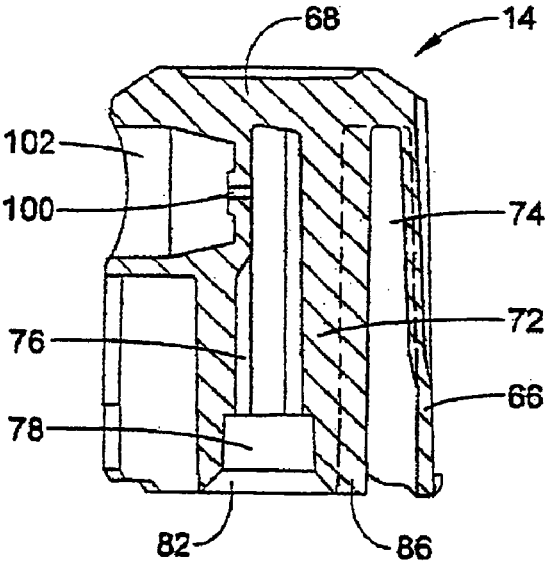
FIG. 4 is a cross-sectional view taken along line 4-4 of FIG. 3.
Figure 7:
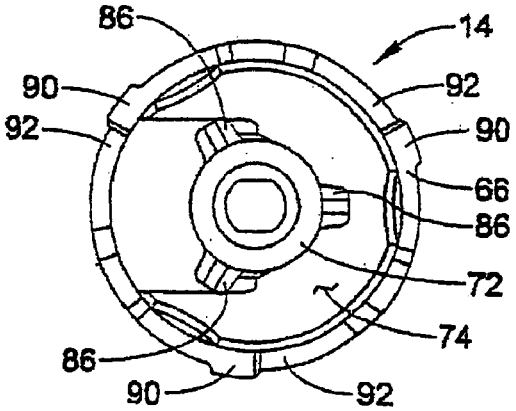
FIG. 7 is a bottom plan view of the actuator button depicted in FIG. 3.

With reference to FIG. 2, a valve cup 18 that forms part of a valve assembly 22 connects to and covers the container (the container 12 is not shown in FIG. 2). The valve cup 18 fits onto the container and is also made of aluminum. The valve cup 18 crimps on to the container 16 via an external crimping action that reduces the diameter of the container and the valve cup at the crimped portion. The valve cup 18 includes an opening 24 through which a valve stem 26 of the valve assembly extends. The valve assembly 22 selectively opens and closes to provide selective dispensing of the liquid cosmetic product stored in the container.

With continued reference to FIG. 2, the valve assembly 22 includes a valve stem 26 that extends through the opening 24 in the cap 18. An annular seal 28 surrounds the valve stem 26. A biasing member, such as a spring 32, biases the valve stem 26 upwardly (as per the orientation depicted in FIG. 2) towards a closed position which is shown in FIG. 2. The biasing member 32 is seated in and acts against a valve seat 34. The annular seal 28 is pressed against an upper inner surface of the cap 18 by the valve seat 34. A second, lower annular seal 36 surrounds the valve seat 34 and abuts an inner cylindrical surface of the container 12 (not depicted in FIG. 2). The container 12 is sandwiched between the valve cup 18 and the valve seat 34 so that these components are fixed in relation to one another. The valve seat 34 defines a valve chamber 38 that receives the spring 32 and a lower portion of the valve stem 26. The valve seat 34 also defines a dip tube chamber 42 that snuggly receives a dip tube 44 that extends into the container 12 (FIG. 1) holding the liquid cosmetic product. The dip tube 42 is in communication with the valve chamber 38 via a passage 46.

To dispense product from the container 16, the valve stem 26 is moved towards the valve seat 34 and acts against the biasing force of the spring 32 to open the valve assembly 22. A radial opening 52 formed in the valve stem 26 is blocked by the annular seal 28 when the valve stem is biased to the closed position as shown in FIG. 2. When the valve stem 26 is moved downwardly with respect to the annular seal 28, then the radial passage 52, which is in communication with an axial passage 54, also communicates with the valve chamber 38, which is under pressure, and the valve chamber is in communication with the dip tube 42 via the passage 46.

The actuator selectively moves the valve stem 26 to dispense the liquid cosmetic product. The dispenser 10 in the depicted embodiment is "capless" for quick actuation. Because the dispenser 10 is capless, i.e. a cap is not removed from the dispenser prior to dispensing product, a locking mechanism, e.g. the locking ring 16 cooperating with an intermediate ring 62, which can also be referred to as a shoulder, is provided to inhibit accidental dispensing of the liquid cosmetic product from the dispenser. If the dispenser is manufactured to be a small size then the user of the dispenser can operate, lock and unlock the dispenser using only one hand if desired. In the depicted embodiment, the locking mechanism is located with respect to the actuator to facilitate one handed operation.

The actuator 14 is movable to move the valve stem 26 against the biasing force of the spring 32. The actuator 14 in the depicted embodiment is generally cylindrical having a closed end and an open end. The actuator in the depicted embodiment has a diameter that is about equal to the diameter of the container 12. In the depicted embodiment the actuator is made from a molded plastic, but other materials and methods of manufacture can be used. With reference to FIGS. 3-7, the actuator 14 includes a generally cylindrical outer wall 66 depending from an upper platform 68 and a stem socket 72 that is radially spaced from the outer wall and depends from the upper platform 68. An annular gap 74 is disposed between the outer wall 66 and the stem socket 72, and as seen in FIG. 2 a portion of a shoulder 62 resides in this gap 74 when the dispenser is finally assembled.

As most clearly seen in FIG. 2, the actuator 14 directly connects to the valve stem 26. To make this connection, a passage 76 is formed in the stem socket 72. With reference back to FIG. 4, the passage includes a lower counterbore 78 that receives the valve stem 26 and a chamfer 82 to facilitate alignment and connection of the actuator 14 to the valve stem 26. The valve stem 26 includes an annular protuberance 84 that radially extends from the outer cylindrical surface of the valve stem 26 and engages with the inner cylindrical surface of the counterbore 78. The outer diameter of the valve stem 26 at the protuberance 84 is slightly larger than the diameter of the counterbore 78 to provide a friction fit between the actuator 14 and the valve stem 26 so that removal of the actuator 14 from the valve stem 26 is difficult. In making the fit, the protuberance 84 and/or the inner surface of the counterbore 78 can deform. Alternatively, the valve stem 26 can be formed with an interlock feature to facilitate a secure attachment and preclude easy removal of the actuator from the valve stem.

In the depicted embodiment, the actuator 14 does not easily rotate with respect to the container 12. The actuator 14 includes a plurality of splines 86 (FIG. 7) that extend from the stem socket 72 to provide the stem socket with a non-circular configuration to control the rotational movement of the actuator button 60 with respect to the shoulder 62 and thus the container 12 in a manner that will be described in more detail below. As most clearly seen in FIG. 7, the splines 86 are angularly spaced 120 degrees from one another around the inner stem socket 72. The splines 86 cooperate with the shoulder 62 in a manner that will be described in more detail below.

The actuator 14 also cooperates with the locking ring 16. The actuator 14 includes external tabs 90 formed on a lower (per the orientation of FIG. 3) end that extend radially outwardly from the generally cylindrical outer wall 66. As most clearly seen in FIG. 7, the external tabs 90 are angularly displaced 120 degrees apart from one another about the circumference of the outer annular wall 66. The actuator 14 also includes a plurality of cutouts 92 formed in and extending upwardly from a lowermost edge 94 of the annular wall 66. In the depicted embodiment, three cutouts 92 spaced 120 degrees apart from one another are formed in the actuator 14. Each cutout 92 terminates adjacent a respective external tab 90.

The actuator 14 also includes an outlet 100 that is in communication with the internal passage 76. In the embodiment where the dispenser is capless, the outlet 100 is always in communication with ambient. The outlet passage 100 connects the internal passage 76 to an outlet cavity 102 that is formed in the actuator. The depth and diameter of the cavity 102 is a function of the pressure at which the liquid product is held in the container as well as function of the diameter of the outlet 100. The liquid product emanates from the fluid outlet 100 and disperses in a radial (cone) fashion outwardly from the fluid outlet. The cavity 102 is dimensional so that little, if any, liquid cosmetic product contacts the cavity wall when being dispensed from the dispenser. Lastly, the actuator 14 includes a plurality of longitudinal recesses 104 that can act as sort of an alignment mechanism for the locking mechanism, which will be described in more detail below.

Figure 9:
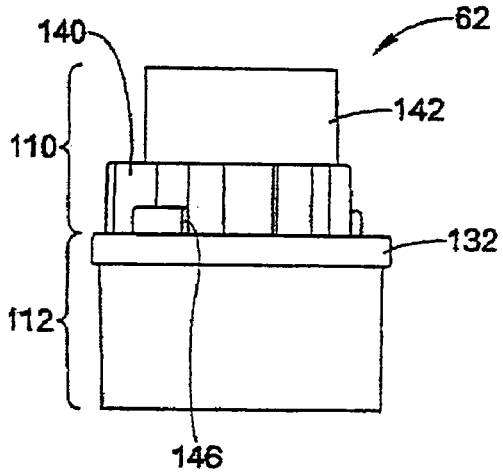
FIG. 9 is a side elevation view of the shoulder depicted in FIG. 8.

With reference to FIG. 2, the shoulder 62 cooperates with the actuator 14 and the locking ring 16. With reference to FIG. 9, the shoulder 62 in the depicted embodiment is a molded plastic part having an upper section 110 and a lower section 112 (as per the orientation depicted in FIG. 9). The upper section 110 and a lower section 112 are both generally cylindrical.

The shoulder 62 fits very snugly to the container 12 so that axial movement (with respect to a central axis of the container) is very difficult as well as rotational movement about the axis. To provide this very snug fit, the lower section 112 of the shoulder 62 includes an inwardly protruding annular protuberance 114 that fits into an axially inwardly directed annular channel or indentation 120 (FIG. 2) formed via the external crimp that is formed in the container 12 and the valve cup 18 for the container. The fit between the shoulder 62 and the container 12 is such that a torque of at least about 0.30 Nm is required to rotate the shoulder with respect to the container and a removal force of at least about 100 N is required to remove the shoulder from the container once it is attached to the container. This allows the shoulder 62 to operate as a relatively stationary component (at least with respect to locking ring 16) of the dispenser and other components, i.e. the actuator 14 and the locking ring 16, can move with respect to the shoulder.

Figure 8:
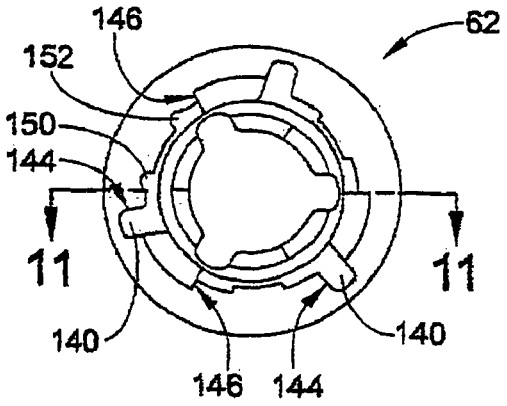
FIG. 8 is a top plan view of a shoulder for the dispenser of FIG. 1.
Figure 10:
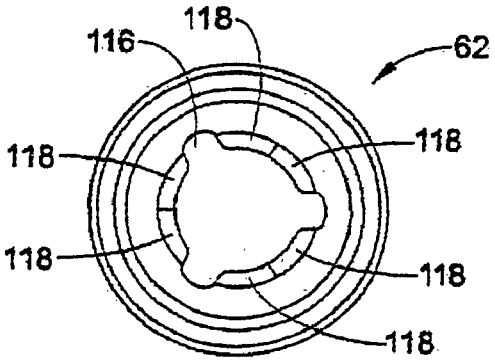
FIG. 10 is a bottom plan view of the shoulder depicted in FIG. 8.
Figure 12:
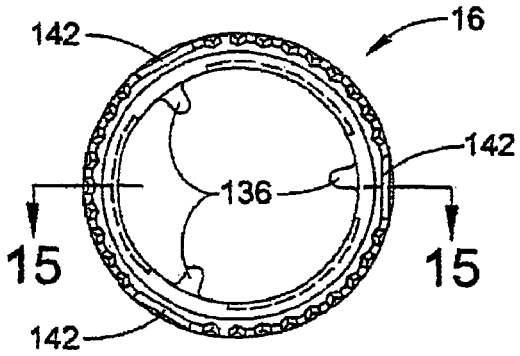
FIG. 12 is a top plan view of a locking ring for the dispenser shown in FIG. 1.
Figure 13:
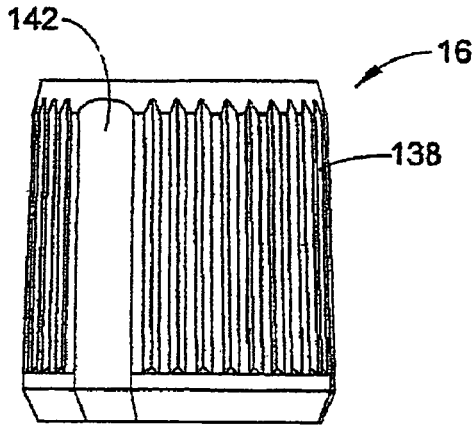
FIG. 13 is a side elevation view of the locking ring shown in FIG. 12.

The shoulder 62 also cooperates with the actuator 14 to inhibit rotational movement of the actuator about the central axis of the container. With reference to FIGS. 8 and 10, tracks or slots 116 that extend outwardly from and longitudinally with a central opening are formed in the upper section 110 of the shoulder 62. The tracks 116 are angularly spaced 120 degrees apart from one another similar to the splines 86 (FIG. 7) formed in the actuator 14. Ramps 118 formed on an inner wall of the upper section 110 are sloped toward the tracks 116 for the splines 86 (FIG. 7) of the actuator 14. The ramps 118 provide an alignment feature for the insertion of the socket stem 86 of the actuator 14 into the central opening of the shoulder 16 during assembly of the dispensers. More precisely, the ramps aid the insertion of the splines of the stem socket into the longitudinal slots of the central opening, thereby easing assembly. When assembled, the splines 86 are slotted into the tracks 116, thereby holding the actuator 14 and shoulder 62 in fixed rotational orientation relative to one another. Also, as seen in FIG. 2, when the actuator is received by the shoulder, the outer wall 66 of the actuator surrounds a portion of the upper section 110 of the shoulder.

With reference to FIGS. 12-15, the locking ring 16 is a tapered annular molded piece of plastic. The locking ring 16 includes an upper inwardly extending annular protrusion 128 that the lower external tabs 90 of the actuator button 60 slide over when the locking ring is placed over the button (see FIG. 2).

Figure 11:
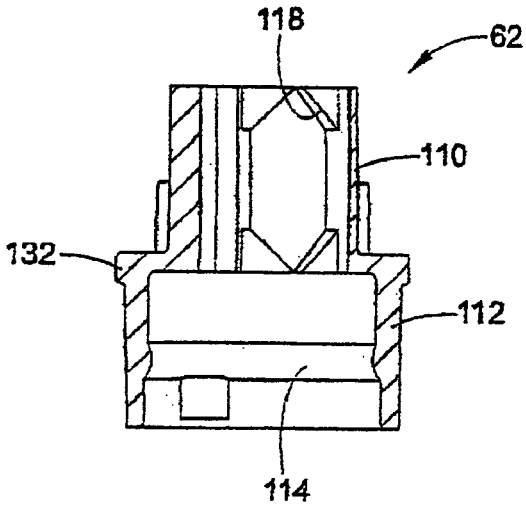
FIG. 11 is a cross-sectional view taken along line 11-11 of FIG. 8.
Figure 15:
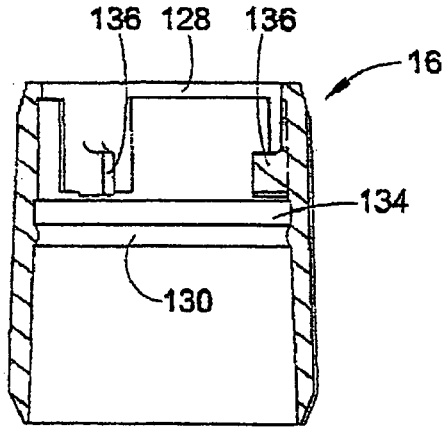
FIG. 15 is a cross-sectional view of the locking ring taken along line 15-15 of FIG. 12.
Figure 14:
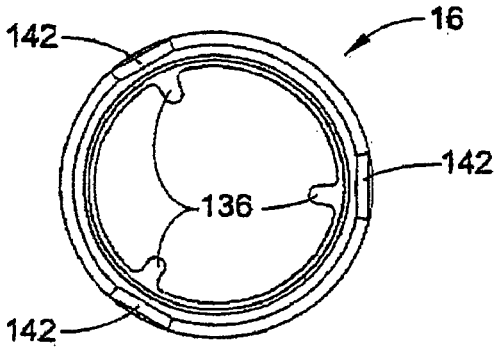
FIG. 14 is a bottom plan view of the locking ring shown in FIG. 12.

The locking ring 16 attaches to the shoulder 62 via a press fit, thereby easing manufacture. More particularly, an inwardly protruding annular ridge 130 is pressed over an outwardly protruding annular ridge 132 (FIGS. 9 and 11) formed at an upper end of the lower section 112 of the shoulder 62. With reference to FIGS. 2 and 15, a channel 134 is formed in the locking ring 64 above the annular ridge 130 that receives the outwardly extending annular ridge 132 (FIG. 11) of the shoulder. The connection between the locking ring 16 and the shoulder 62 precludes axial movement (the axis being defined as the central axis of the container 12) while allowing rotational movement about the axis of the locking ring with respect to the shoulder. Desirably, the locking ring 64 can rotate with respect to the shoulder 62 upon the application of a torque between about 0.02 Nm to about 0.06 Nm, which is much less than the torque required to rotate the shoulder 62 about the container 12. The upper torque limit, i.e. about 0.06 Nm, is determined to provide an ease of use. If the torque is too high, then it is difficult for an operator to rotate the locking ring 64. The lower torque limit is selected to inhibit accidental rotation. If the torque required to rotate the locking ring 64 is too low, then the locking ring may be able to be too easily inadvertently rotated.

A plurality of inwardly protruding tabs 136 are provided on the locking ring 16 and cooperate with the actuator 14 to selectively limit the axial movement of the actuator with respect to the locking ring and more particularly with respect to the container to control opening and closing the valve assembly 22. With reference back to FIG. 6, the tabs 136, which are angularly spaced 120 degrees apart from one another, cooperate with the lower edge of the actuator 14 and the cutouts 92. In a first position, an upper surface of each tab 136 contacts the lowermost edge of the outer wall of the actuator (FIG. 6) such that the actuator is precluded from moving axially with respect to the container 12 and as such is "locked." When the locking ring 64 is rotated (desirably less than about 90 degrees) to a second position, the tabs 136 align with the cutouts 92 to allow the actuator to move axially with respect to the container thus opening the valve assembly 22, whereby the tabs 136 reside in the cutouts 92 as the button 60 is pressed downwardly. The rotation between the first "locked" position and the second "unlocked" position may be reversible.

Annular ridges 138 can be provided on an outer surface of the locking ring 64 to facilitate gripping and rotation of the locking ring. Smooth surfaces 142 can also be provided on the locking ring 64 interposed between the vertical ridges as an alignment feature or indicia to indicate whether the dispenser is in a "locked" or an "unlocked" position. The smooth surfaces 142 can align with the longitudinal recesses 104 in the actuator button 60 to indicate a "locked" or "unlocked" position.

The tabs 136 also cooperate with the shoulder 62 to limit the angular rotational displacement of the locking ring 16 with respect to the shoulder. With reference back to FIGS. 8 and 9, the shoulder 62 includes wings 140 extending outwardly from a cylindrical smooth wall 142. The wings 140 are disposed on a lower half of the upper section 110 and a smooth cylindrical wall 142 is provided on the upper half. The wings 140 provide a first contact surface 144 against which the tabs 136 (FIG. 12) on the locking ring contact when the locking ring is rotated with respect to the shoulder. A second contact surface 146 that is angularly spaced from the first contact surface is also found on the upper section 110 of the shoulder. The tabs 136 (FIG. 13) of the locking ring 64 move between the contact surfaces 144 and 146. When the tabs 136 contact the contact surface 144, the dispenser is in the "locked" position. When the tabs 136 contact the second contact surface 146, the dispenser is in the "unlocked" position.

With reference to FIG. 8, bumps 150 and 152 are disposed between a set of contact surfaces 144 and 146. The bumps 150 and 152 cooperate with the tabs 136 and the locking ring to provide an indexing and/or locking feature to allow the user of the dispenser to know the state, e.g. locked or unlocked, in which the dispenser is disposed. The tabs 136 ride over the bumps 150 and 152 to provide an interference or snap fit.

A liquid or fluid dispenser has been described with reference to certain embodiments. The dispenser can dispense all sorts of liquid cosmetic products, including, hair spray, body spray, antiperspirant, deodorant, perfume, cologne, as well as other products that are typically dispensed via an aerosol can. Many available alterations may occur to those skilled in the art upon reading the preceding detailed description. The invention is not intended to be limited solely to those embodiments described above, but is intended to include any device that comes within the scope of the appended claims.

The invention claimed is:

1. An aerosol fluid dispenser comprising:

a rigid container defining a chamber for storing a fluid that is to be dispensed;

a valve assembly including a valve cup and a movable valve stem, the valve cup connected to the container and defining an opening in fluid communication with the chamber, and the movable valve stem disposed in the opening for selectively closing the opening and retaining the fluid in the container at a pressure that is greater than atmospheric pressure;

a shoulder connected to and surrounding an external surface of the container and including a central opening and at least one slot extending from the central opening;

a spray through actuator received in the central opening of the shoulder and including an outlet for dispensing the fluid, an upper platform, a stem socket depending downwardly from the upper platform and an outer wall extending downwardly from the upper platform and at least substantially surrounding the stem socket, the stem socket defining a passage that receives the valve stem and is in communication with the outlet, the stem socket including at least one spline that is received in the at least one slot to inhibit rotational movement of the actuator with respect to the shoulder;

a spring located above a seat for the valve stem, beneath and aligned in the same axial direction as the actuator, which provides a biasing force against the vertical up and down motion of the actuator; and a locking ring rotatably connected to the shoulder and cooperating with the actuator to limit axial movement of the actuator.

2. The dispenser of claim 1, wherein the valve cup is externally crimped to the rigid container.

3. The dispenser of claim 2, wherein the shoulder includes an inwardly protruding annular protuberance that fits into an indentation formed in the container and the valve cup for the container.

4. The dispenser of claim 1, wherein at least one slot extending from the central opening of the shoulder is a longitudinal track.

5. The dispenser of claim 4, wherein ramps formed on an inner wall of an upper section of the shoulder are sloped towards the longitudinal track in order to aid the insertion of the spline of the stem socket into the longitudinal track of the central opening of the shoulder during manufacture.

6. The dispenser of claim 4, wherein there are three splines, each being received in a longitudinal track extending from the central opening of the shoulder, the three splines and three slots being angularly spaced 120 degrees from one another.

7. The dispenser of claim 5 wherein there are three splines, each being received in a longitudinal track extending from the central opening of the shoulder, the three splines and three slots being angularly spaced 120 degrees from one another.

8. The dispenser of claim 1, wherein the locking ring is a tapered annular molded piece of plastic.

9. The dispenser of claim 1, wherein the locking ring comprises a plurality of inwardly protruding tabs which cooperate with the actuator to selectively limit the axial movement of the actuator with respect to the locking ring and more particularly with respect to the container to control opening and closing of the valve assembly.

10. The dispenser of claim 1, wherein the outer wall of the actuator comprises a lowermost edge and a plurality of cutouts are formed therein and extend upwards therefrom.

11. The dispenser of claim 9, wherein the locking ring may be rotated between a first position in which an upper surface of each tab contacts the lowermost edge of the outer wall actuator such that the actuator is precluded from moving axially with respect to the container and a second position in which the tabs align with cutouts formed in the outer wall of the actuator thereby allowing the actuator to move axially.

12. The dispenser of claim 10, wherein the locking ring may be rotated between a first position in which an upper surface of a plurality of inwardly protruding tabs on the locking ring contacts the lowermost edge of the outer wall actuator such that the actuator is precluded from moving axially with respect to the container and a second position in which the tabs align with the cutouts formed in the outer wall thereby allowing the actuator to move axially.

13. The dispenser of claim 1, wherein the container has a volume of less than 60 ml.

14. The dispenser of claim 1, wherein the fit between the shoulder and the container is such that a torque of at least 0.30 Nm is required to rotate the shoulder with respect to the container.

15. The dispenser of claim 14, wherein the fit between the shoulder and the container is such that a force of at least 100 N is required to remove the shoulder from the container, once it is attached.

16. The dispenser of claim 1, wherein a passage in the actuator comprises a lower counterbore that receives the valve stem, the valve stem having an annular protuberance that extends radially from its outer surface and engages with the inner surface of the counterbore.

17. The dispenser of claim 16, comprising a chamfer below the lower counterbore to facilitate alignment and connection of the actuator to the valve stem.

18. The dispenser of claim 16, wherein the outer diameter of the valve stem at the protuberance is slightly larger than the diameter of the counterbore, the valve stem at the protuberance and/or the inner surface of the counterbore being deformable to ease manufacturing.

19. The dispenser of claim 17, wherein the outer diameter of the valve stem at the protuberance is slightly larger than the diameter of the counterbore, the valve stem at the protuberance and/or the inner surface of the counterbore being deformable to ease manufacturing.

* * * * *